US005146638A

United States Patent [19]

Richards

[11] Patent Number: 5,146,638

[45] Date of Patent: Sep. 15, 1992

[54] BATH

[75] Inventor: Derek J. Richards, Longhope, England

[73] Assignee: Arjo Mecanaids Limited, Gloucester, England

[21] Appl. No.: 663,325

[22] Filed: Mar. 1, 1991

[30] Foreign Application Priority Data

Mar. 23, 1990 [GB] United Kingdom ..... 9006507

[51] Int. Cl.[5] ..... A47K 3/12

[52] U.S. Cl. ..... 4/562.1; 4/565.1

[58] Field of Search ..... 4/561, 562, 563, 564, 4/565, 566, 496

[56] References Cited

U.S. PATENT DOCUMENTS

| | | | |
|---|---|---|---|
| 2,187,283 | 1/1940 | Scheutz | 4/561 X |
| 3,078,473 | 2/1963 | Daniels | 4/563 |
| 3,078,475 | 2/1963 | Turner | 4/562 |
| 3,268,918 | 8/1966 | Batty et al. | 4/563 |
| 3,815,163 | 6/1974 | Sullivan | 4/562 |
| 3,994,030 | 11/1976 | Cassell et al. | 4/563 |
| 4,624,019 | 11/1986 | Pennington-Richards | 4/566 |
| 4,928,330 | 5/1990 | Moore | 4/562 |

FOREIGN PATENT DOCUMENTS

| | | | |
|---|---|---|---|
| 2512595 | 10/1975 | Fed. Rep. of Germany . | |
| 3511267 | 10/1986 | Fed. Rep. of Germany . | |
| 2614527 | 11/1988 | France . | |
| 744155 | 2/1956 | United Kingdom . | |
| 2123285 | 2/1984 | United Kingdom . | |
| 2131291 | 6/1984 | United Kingdom . | |
| 2197636 | 5/1988 | United Kingdom | 4/561 |
| 2222767 | 3/1990 | United Kingdom . | |
| 8302721 | 8/1983 | World Int. Prop. O. | 4/563 |
| 85/05267 | 12/1985 | World Int. Prop. O. . | |
| 88/00820 | 2/1988 | World Int. Prop. O. . | |

*Primary Examiner*—Henry J. Recla
*Assistant Examiner*—Robert M. Fetsuga
*Attorney, Agent, or Firm*—Young & Thompson

[57] ABSTRACT

A bath comprises a bath tub and apparatus for assisting persons into and out of the bath tub. The apparatus comprises a lifting column in the form of a telescopic mast, a seat supported by the mast, a first actuator provided for the most part within the mast, for raising and lowering the seat relative to the bath tub, and a second actuator for angularly displacing the mast. The apparatus also comprises a control device for operating the first and second actuators so as to raise the seat from a lowered to an elevated position and to then swivel the seat to a position in which it extends over a rim of the bath tub, and so as to swivel the seat in an opposite direction and to then lower the seat into the bath tub.

9 Claims, 5 Drawing Sheets

BATH

INTRODUCTION

This invention relates to a bath comprising a bath tub and apparatus for assisting persons, particularly elderly and physically disabled persons, into and out of the bath tub.

Lifting devices are known for assisting elderly and physically disabled persons into and out of a bath. One such lifting device is designed to be fixed to the floor beside the bath. This has its place, but it takes up space which is often at a premium. Several other known lifting devices are designed as non-permanent fixtures and can be placed in or removed from a standard bath at will. Again these have their place, but these lifting devices have a seat which can only be raised and lowered and cannot swivel, with the result that they have limited application and are generally not suitable for wheelchair bound persons. It is also known to provide lifting devices as permanent fixtures in a bath, but the seats of these known devices are freely swivellable when in an elevated position, and this can prove hazardous particularly to wheelchair bound persons as they attempt to transfer from a wheelchair to the seat of the lifting device.

SUMMARY OF THE INVENTION

According to the present invention, there is provided a bath comprising a bath tub and apparatus for assisting persons into and out of the bath tub, the apparatus comprising a lifting column, a seat supported by the lifting column, a first actuator mounted with respect to the lifting column for raising and lowering the seat relative to the bath tub, and a second actuator for angularly displacing the lifting column, thereby causing the seat to swivel, when the seat is in an elevated position relative to the bath tub.

Preferably, the lifting column extends through a hole in one end of the bath tub.

Conveniently, the first and second actuators are electro-mechanical or electro-hydraulic actuators.

Advantageously, the lifting column is in the form of a telescopic mast having a lower part fixed against vertical movement and an upper part which can be extended and retracted relative to the lower part by the first actuator.

Preferably, the second actuator comprises two mutually telescopic parts which are extendible and retractable relative to one another in a horizontal plane, one of the parts being pivotally connected to a fixed point, e.g. a frame of the bath, and the other part being pivotally connected to an arm secured to and extending horizontally from the lifting column.

Preferably, the apparatus comprises a control device for operating the first and second actuators so as to raise the seat from a lowered to an elevated position and to then swivel the seat in one direction to a position in which the seat extends over a rim of the bath tub and so as to swivel the seat in an opposite direction and to then lower the seat into the bath tub. In this case, the control device may include sensors, e.g. limit switches, for sensing when the seat reaches a fully elevated position in which it can then be swivelled without fouling the bath tub and for sensing when the seat reaches an angular position in which it can be lowered into the tub without fouling the sides thereof. The control device may provide an automatic delay between raising and swivelling the seat, and between swivelling and lowering the seat, to lessen the abruptness of the transitions between raising and swivelling, and between swivelling and lowering of the seat.

Conveniently, the bath tub has a shallow well for receiving a squab portion of the seat when the latter is in a lowered position.

Preferably, the seat has arm rests, one of which is displaceable to provide ease of access to the seat.

The invention will now be more particularly described, by way of example only, with reference to the accompanying drawings.

DESCRIPTION OF THE PREFERRED EMBODIMENT

Figure 1:
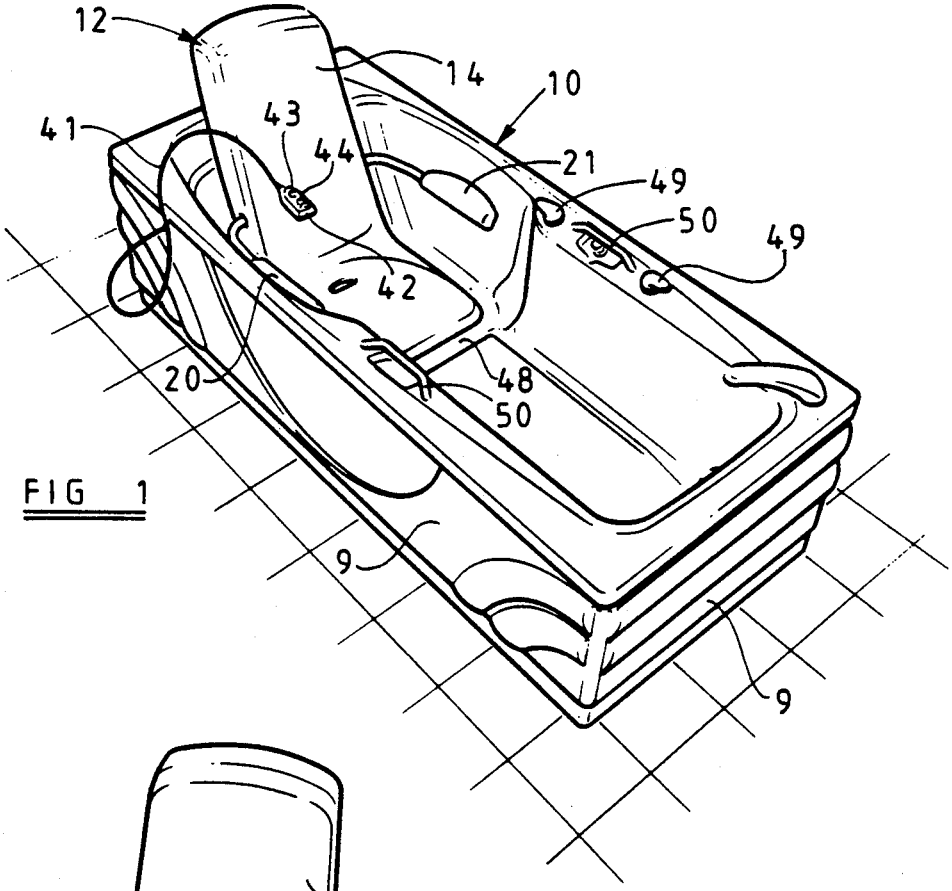
FIG. 1 is a perspective view of one embodiment of a bath according to the present invention, with the seat in a lowered position.

Referring to the drawings, the bath shown therein comprises a bath tub 10, a frame 11 supporting the tub 10, and apparatus 12 for assisting physically disabled persons into and out of the tub 10.

The apparatus 12 comprises a lifting column in the form of a telescopic mast 13 supported in an upright position by the frame 11 and the bath tub 10, and a seat 14 supported by the mast 13.

The mast 13 comprises a lower mast part 15 which is mounted beneath the bath tub 10 and concealed from view behind bath panels 9, and an upper mast part 16 which extends through a hole in the top of an upwardly extending bulge 17 formed centrally in an end portion of the rim of the bath tub 10. The upper mast part 16 is slidable in the lower mast part 15 between a retracted position (shown in FIGS. 1, 3 and 5) and an extended position (shown in FIGS. 2 and 6).

The seat 14 is of a semi-rigid plastics material having a metal plate 18 moulded into the back of the seat and two armrests 20 and 21 pivotally connected to the plate 18 so that they can be swung upwards. The seat is firmly secured to the upper end of the upper mast part 16 by a bracket 19 which is secured to the plate 18 and to the upper end of the upper mast part.

Figure 3:
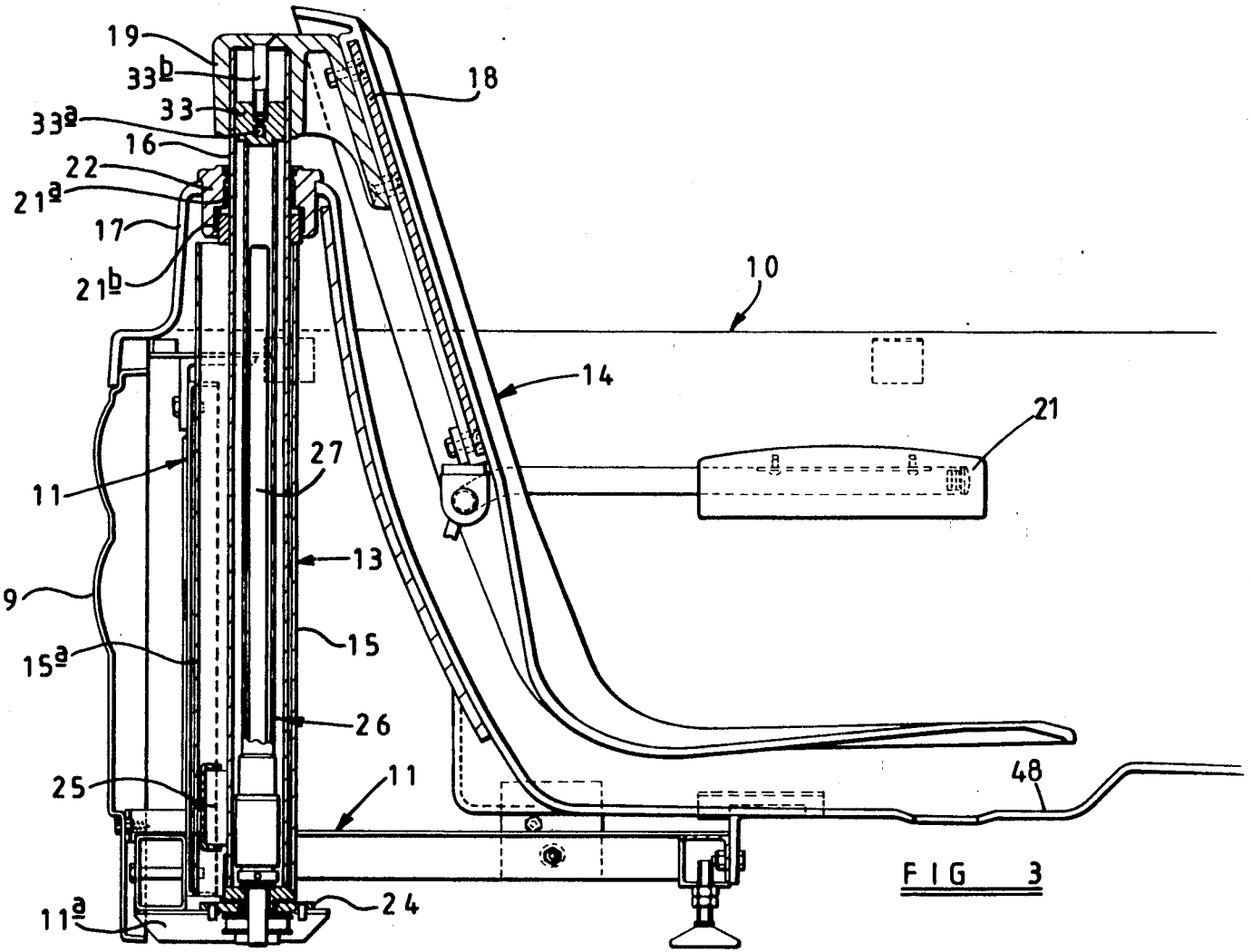
FIG. 3 is a vertical section taken through part of the bath shown in FIG. 1 on an enlarged scale.
Figure 4:
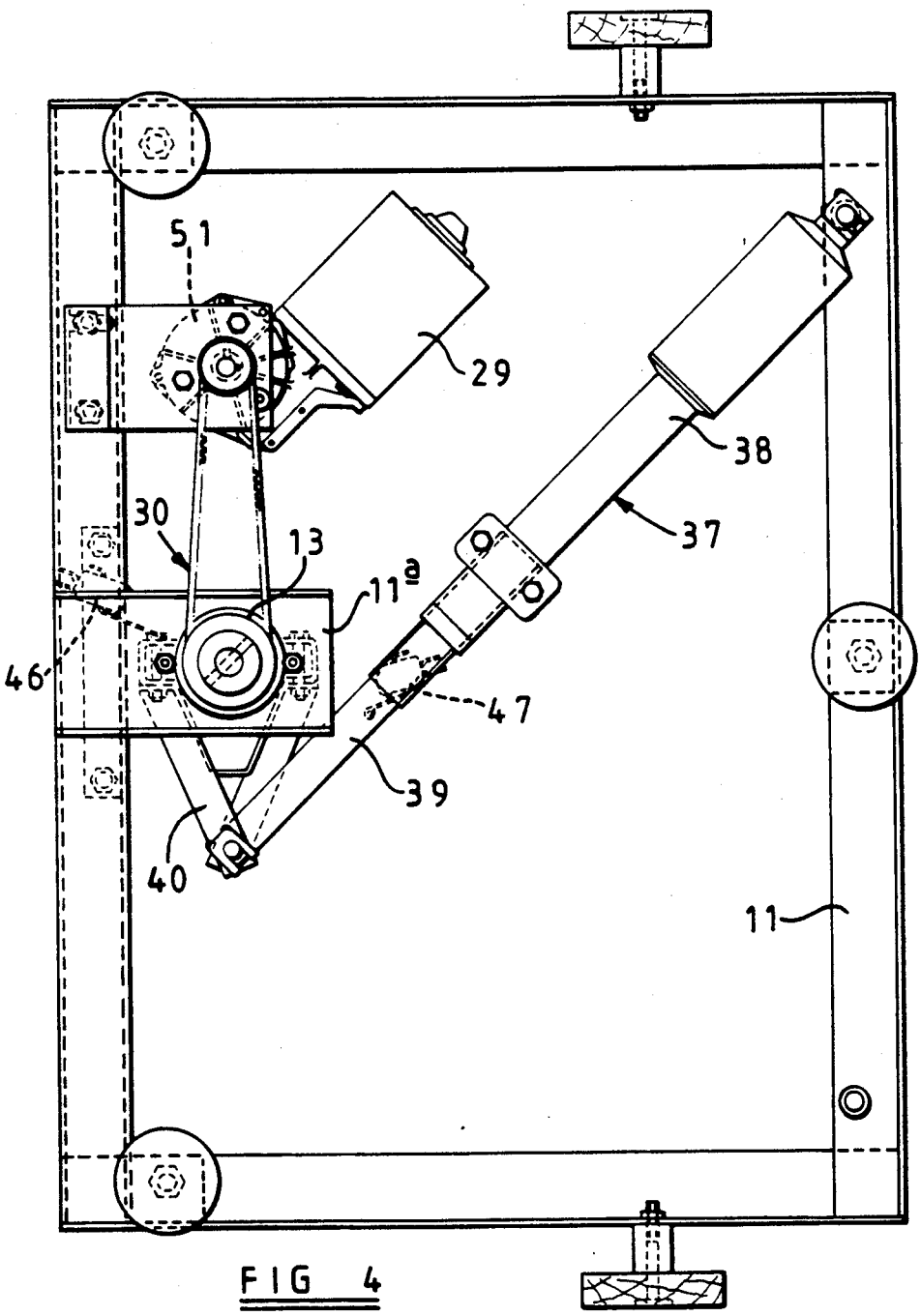
FIG. 4 is an underneath plan view of part of the bath shown in FIG. 1 on an enlarged scale.
Figure 5:
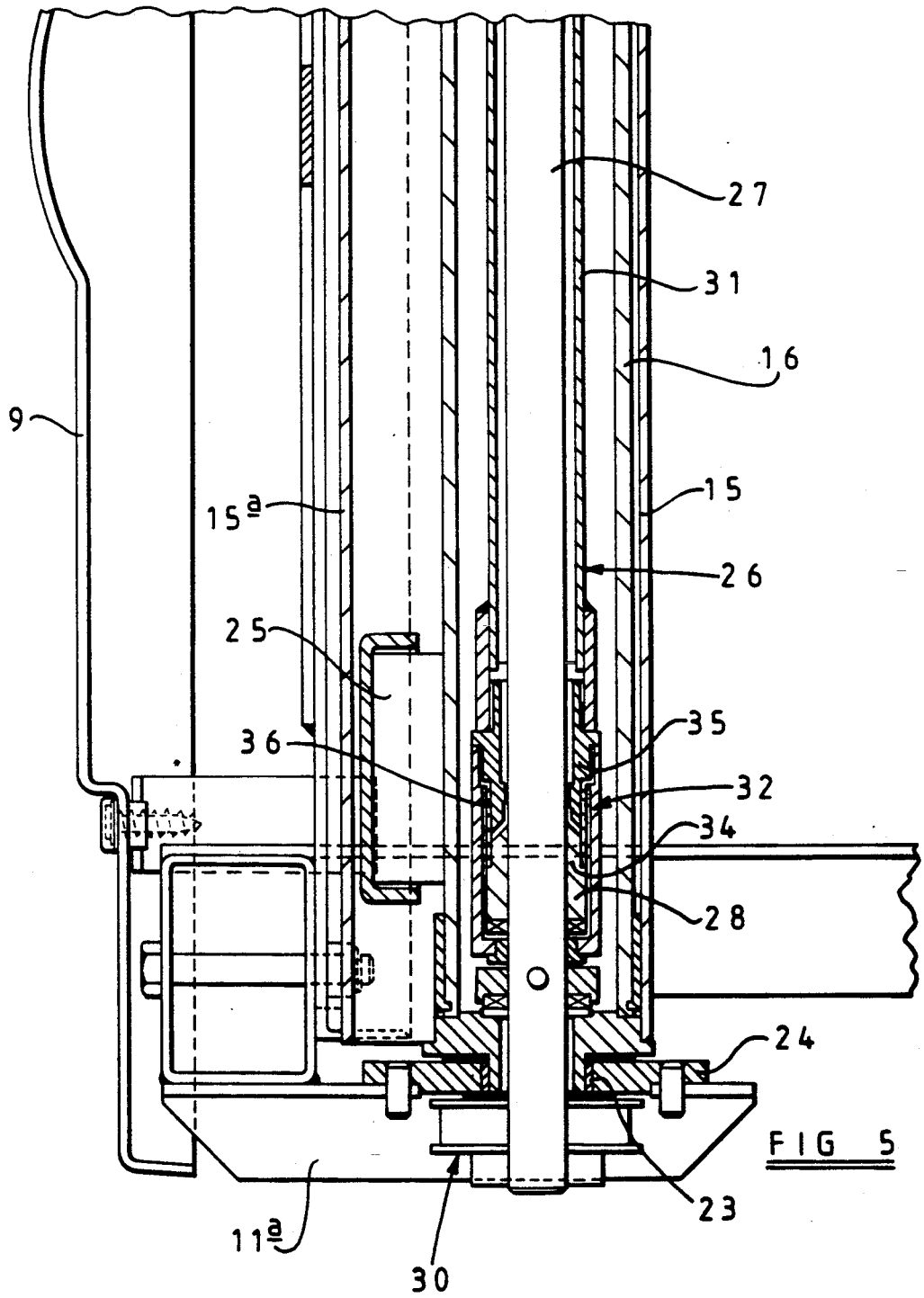
FIG. 5 is a detailed vertical section through the lower end of the lifting column and actuator therein on a much enlarged scale.
Figure 6:
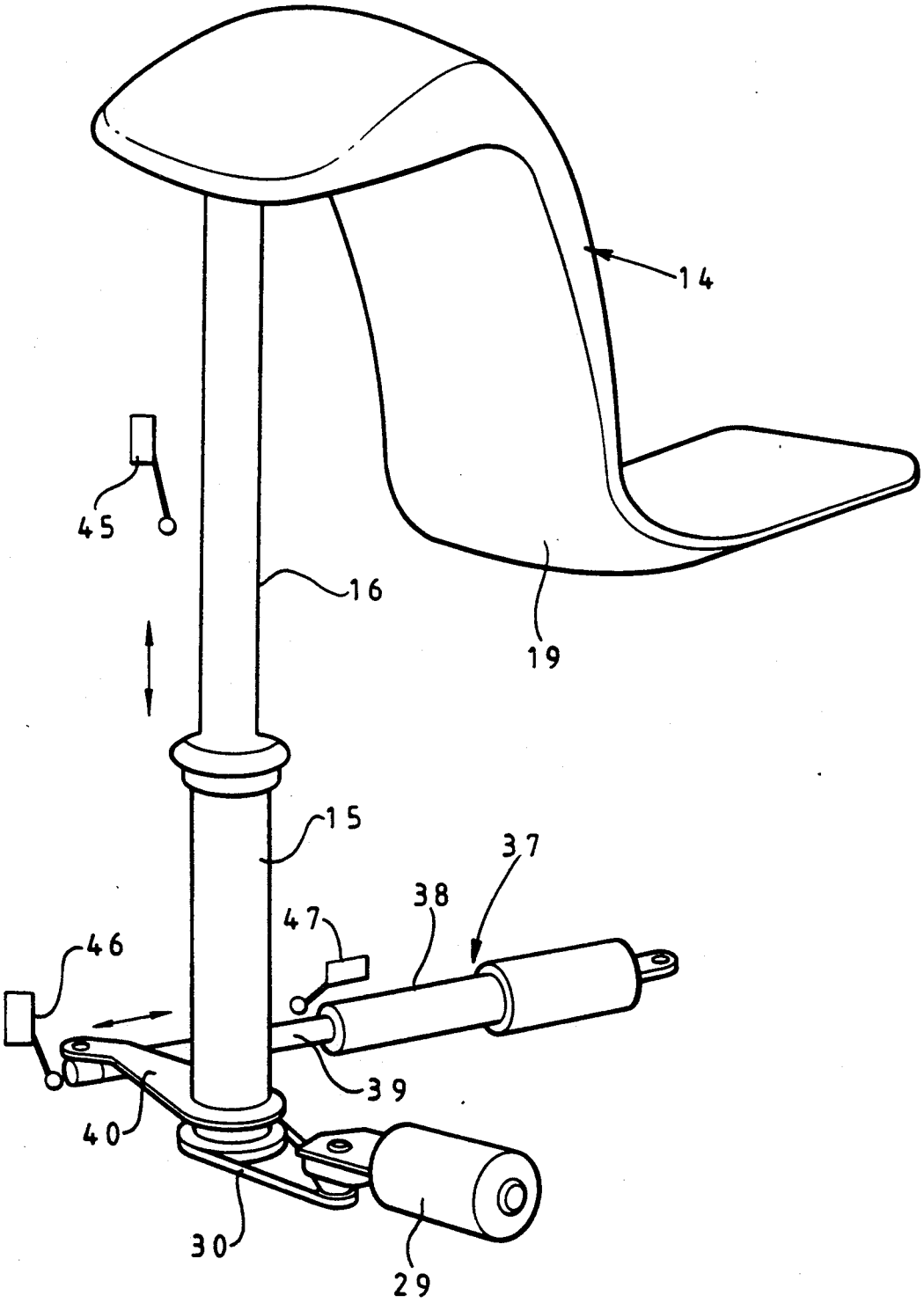
FIG. 6 is a schematic view of the lifting apparatus on its own.

As best shown in FIGS. 3 & 5, the mast 13 is supported for angular movement about a vertical (or substantially vertical) axis by sleeve bearings **21*a* and 21*b* provided in a bush 22, and by a sleeve bearing 23 provided in a plate-like housing 24. The bush 22 is mounted in a hole in the top of bulge 17 and the housing 24 is secured to a section 11*a* of the frame 11. The lower mast part is prevented from moving axially (i.e. vertically) by the bush 22 and the plate-like housing 24, and the upper mast part 16 is slidable in the upper bearing 21*a* so that it can be extended and retracted relative to the lower mast part 15 by an electro-mechanical actuator 26 provided for the most part within the mast 13**.

A slider block 25 is fixed to the outside of the upper mast part 16 and co-operates with an outwardly projecting, longitudinally extending slideway 15*a* provided in the lower mast part 15, to prevent relative angular movement of the upper and lower mast parts.

The actuator 26 comprises a threaded rod 27, a nut 28 co-operable with the rod 27, an electric motor 29 and reduction gearbox 51, coupled to the threaded rod 27 by a toothed belt and pulley drive 30, a tube 31, and an overrun clutch 32 between the nut 28 and the tube 31.

A cylindrical plug 33 is secured to the upper end of the tube 31 and this plug 33 is connected to the upper mast part 16 by a transverse pin 33*a* and to the bracket 19 by a threaded bolt 33*b*.

As shown in FIG. 5, the overrun clutch 32 comprises a first clutch member 34 integral with the nut 28, a second clutch member 35 fixed to the lower end of the tube 31, and a helical spring 36 mounted about the two clutch members 34 and 35. When the motor 29 is rotated to raise the seat 14, the spring 36 will tighten and the clutch members 34 and 35 will be drawn together. This will ensure that the nut 28 cannot rotate and it therefore rides upwards on the threaded rod 27 and extends the mast 13. When the motor 29 is rotated to lower the seat 14, if the seat 14 meets with an obstruction, the spring 36 will slacken. The nut 28 can then rotate with the threaded rod 27.

The mast 13 can be displaced angularly by a second electro-mechanical actuator 37 in order to swivel the seat 14 when the latter is in an elevated position. The actuator 37 has two telescopically extendible/retractable parts 38 and 39, and is of a type made by Linak A/S of Denmark under model no. LA 22.5. The actuator part 38 is pivotally connected to the frame 11 and the actuator part 39 is pivotally connected to a lever arm 40 projecting radially from the lower end of the lower mast part 15. Thus, it will be seen that when the two parts 38 and 39 of the actuator 37 are retracted, with the seat in an elevated position, the mast 13 will turn clockwise as viewed in plan, and the seat 14 will swivel over a side portion of the rim of the bath tub 10, as shown in FIG. 2.

A control device for the actuators 26 and 37 operates in response to pneumatic signals transmitted along air lines 41 from a remote controller 42. The control device is designed to move the seat 14 from a bathing position as shown in FIG. 1 to a mounting position as shown in FIG. 2 and vice versa, while, in each case, an operator (usually the user) holds an appropriate button 43, 44 on the controller 42 in a depressed condition. The control device also includes three limit switches 45, 46 and 47 (shown diagrammatically in FIG. 6). Switch 45 senses the fully extended condition of the mast 13; switch 46 senses the extended condition of the actuator 37, that is when the mast 13 is in a position in which the seat 14 is in the bath tub 10 or in a position in which it can be lowered into the bath tub 10 without fouling the sides of the tub 10; and switch 47 senses the fully retracted condition of the actuator 37.

Thus, in operation, in order to raise the seat 14 from a bathing position to a mounting position, the appropriate button 43 on the controller 42 is depressed and held depressed. The control device will first energize the motor 29 of the actuator 26 so that an elevated position in which it can be swivelled over the rim of the bath tub 10. The limit switch 45 will change condition when the seat 14 reaches this position, and the motor 29 will be de-energized. After a short deliberate delay provided by electronic circuitry, the control device will energize the actuator 37. The two parts 38, 39 of the actuator 37 will retract relative to one another and the lever arm 26 will move clockwise as viewed in plan to angularly displace the mast 13 about its axis and swivel the seat 14 over the rim of the bath tub 10. As the seat 14 starts to swivel the limit switch 46 will change condition. The seat 14 will continue to swivel until the button 43 is released or the seat 14 reaches an end of travel position, such as that shown in FIG. 2, when the limit switch 47 will change condition and the actuator 37 will be de-energized. The seat 14 will be swivelled to the position shown in FIG. 2 if it is to be mounted by a non-wheelchair bound person, but transfer from a wheelchair to the seat 14 is more easily accomplished if the seat 14 is swivelled through a smaller angle, and in order to facilitate transfer from a wheelchair to the seat 14, the arm rest 20 is swung upwards and out of the way.

Figure 2:
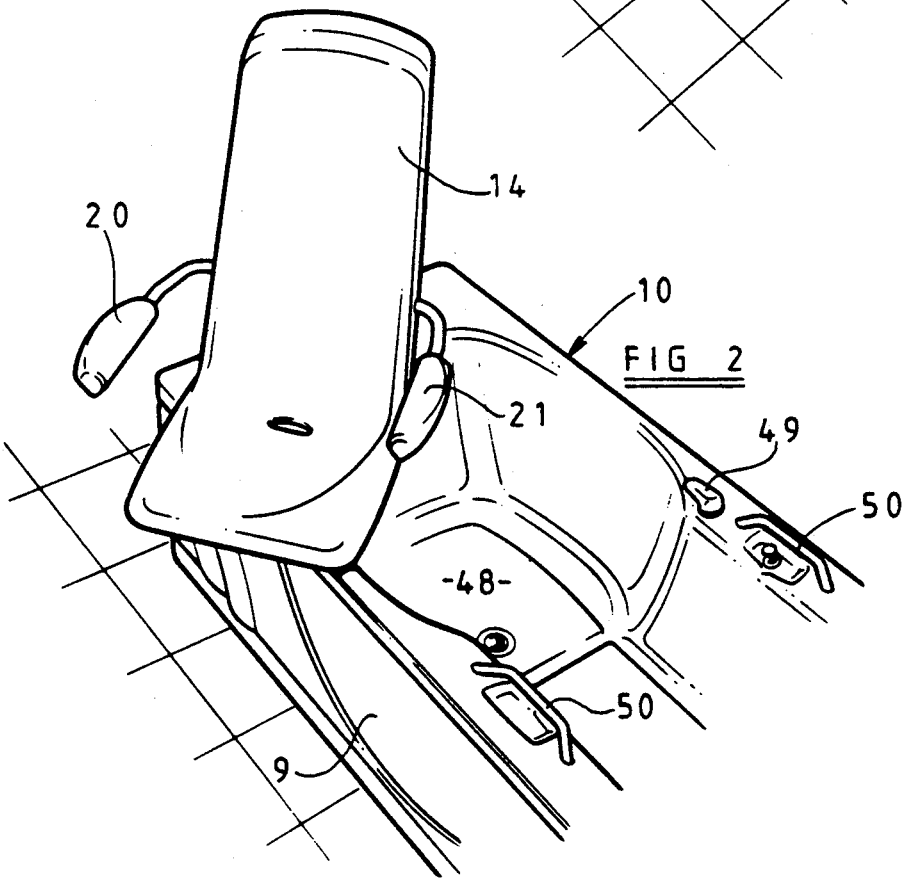
FIG. 2 is a fragmentary perspective view showing the seat of FIG. 1 in a position in which it can be mounted by an elderly or physically disabled person.

When the user is safely on the seat 14, the arm rest 20 is returned to the position shown in FIGS. 1 and 2, and the button 44 on the controller 42 is depressed. This will energize the actuator 37. The two parts 38, 39 of the actuator 37 will extend relative to clockwise, as viewed in plan, to angularly displace the mast 13 about its axis and swivel the seat 14 back over the rim of the bath tub 10. The movement of the seat 14 can be temporarily arrested at any time by releasing the button 44, to allow the user or an attendant to lift the user's legs over the side of the bath tub 10. When the seat 14 reaches an end of travel position, the limit switch 46 will revert to its original condition and the actuator 37 will be de-energized. After a short deliberate delay provided by electronic circuitry, the control device will energize the actuator 26. The mast 13 will retract. The limit switch 45 will revert to its original condition and the seat 14, together with the user, will be lowered into the bath tub 10. After bathing, the user can be assisted out of the bath by again depressing the button 43 to again raise and then swivel the seat 14.

As shown, the bath tub 10 has a shallow well 48 for receiving the squab portion of the seat 14 when the latter is its lowermost position. The bath is also provided with control valves 49 for the hot and cold water supply, midway along one side of the bath so that these are within easy reach of a user, and hand holds 50.

The embodiment described above is given by way of example only and various modifications will be apparent to persons skilled in the art without departing from the scope of the invention. For example, one or both of the actuators 26 and 37 could be electro-hydraulic actuators instead of being electro-mechanical actuators. Also, arm rest 21 could be fixed and only arm rest 20 pivotable relative to the seat.

What is claimed is:

1. A bath comprising a bath tub having an upper rim and apparatus for assisting persons into and out of the bath tub, the apparatus comprising a lifting column having a first actuator movably mounted therewith, a seat supported by the first actuator, said first actuator being operable for raising and lowering the seat relative to the bath tub, and a second actuator connected to the lifting column for angularly displacing the lifting column, thereby causing the seat to swivel when the first actuator is in an elevated position, said lifting column extending through a hole in the bath tub rim at one end of the bath tub, said bath tub including at least one panel extending downwardly from the rim and said second actuator being disposed below the bath tub rim and behind the panel so as to be concealed from view.

2. A bath as claimed in claim 1, wherein the first and second actuators are electrically powered.

3. A bath as claimed in claim 2, wherein at least one of the actuators is an electro-mechanical actuator.

4. A bath as claimed in claim 1, wherein the lifting column is in the form of a telescopic mast having a lower part fixed against vertical movement and an upper part comprised of the first actuator which can be extended and retracted relative to the lower part.

5. A bath as claimed in claim 1, wherein the second actuator comprises two mutually telescopic parts which are extendable and retractable relative to one another in a horizontal plane, and an arm is secured to and extends horizontally from the lifting column, one of the parts of the second actuator being pivotally connected to a fixed point and the other part being pivotally connected to said arm.

6. A bath as claimed in claim 1, wherein the apparatus comprises a control device for operating the first and second actuators so as to raise the seat from a lowered to an elevated position and to then swivel the seat in one direction to a position in which the seat extends over a rim of the bath tub, and so as to swivel the seat in an opposite direction and to then lower the seat into the bath tub.

7. A bath as claimed in claim 6, wherein the control device includes sensors for sensing when the seat reaches a fully elevated position in which it can then be swivelled without fouling the bath tub and for sensing when the seat reaches an angular position in which it can be lowered into the tub without fouling the sides thereof.

8. A bath as claimed in claim 6, wherein the control device includes means for providing an automatic delay between raising and swivelling the seat, and between swivelling and lowering the seat.

9. A bath as claimed in claim 1, wherein the seat has arm rests, one of which is displaceable to provide ease of access to the seat.

* * * * *